US009289908B2

(12) United States Patent
Marder

(10) Patent No.: US 9,289,908 B2
(45) Date of Patent: Mar. 22, 2016

(54) MULTI-HEADED RAZOR DEVICE

(71) Applicant: Andrea Lee Marder, New Bedford, MA (US)

(72) Inventor: Andrea Lee Marder, New Bedford, MA (US)

( * ) Notice: Subject to any disclaimer, the term of this patent is extended or adjusted under 35 U.S.C. 154(b) by 117 days.

(21) Appl. No.: 14/022,803

(22) Filed: Sep. 10, 2013

(65) Prior Publication Data

US 2014/0068948 A1 Mar. 13, 2014

Related U.S. Application Data

(60) Provisional application No. 61/699,058, filed on Sep. 10, 2012.

(51) Int. Cl.
*B26B 21/22* (2006.01)
*B26B 21/52* (2006.01)

(52) U.S. Cl.
CPC ..... *B26B 21/225* (2013.01); *B26B 21/222* (2013.01); *B26B 21/52* (2013.01); *B26B 21/521* (2013.01)

(58) Field of Classification Search
CPC .... B26B 21/222; B26B 21/225; B26B 21/52; B26B 21/521
USPC ..... D28/44, 45, 46, 47, 48
See application file for complete search history.

(56) References Cited

U.S. PATENT DOCUMENTS

| | | | | |
|---|---|---|---|---|
| 2,587,964 | A * | 3/1952 | Burns | 30/30 |
| 4,501,066 | A * | 2/1985 | Sceberras | 30/50 |
| 4,989,328 | A * | 2/1991 | Sokoloff | 30/34.1 |
| 5,307,564 | A * | 5/1994 | Schoenberg | 30/50 |
| 6,052,905 | A * | 4/2000 | Branchinelli et al. | 30/50 |
| 6,141,875 | A * | 11/2000 | Andrews | 30/50 |
| 6,308,416 | B1 * | 10/2001 | Bosy et al. | 30/50 |
| 6,418,623 | B1 * | 7/2002 | Marcarelli | 30/50 |
| 2007/0283567 | A1 * | 12/2007 | Magli | 30/50 |
| 2011/0041342 | A1 * | 2/2011 | Starr | 30/50 |

* cited by examiner

*Primary Examiner* — Stephen Choi

(57) ABSTRACT

A multi-headed razor device may be used to shave a surface area not covered by an individual razor. The device may include a handle body having a first end, a plurality of handle arms having a first end and a second end attached to the handle body, a plurality of razor heads attached to the first end of the handle body and the first end of the plurality of handle arms. A plurality of release buttons may be attached to the first end of the handle body and the first end of the plurality of handle arms to release the plurality of razor heads. A plurality of buttons may be attached to a top portion of the handle body to release the plurality of handle arms.

12 Claims, 4 Drawing Sheets

MULTI-HEADED RAZOR DEVICE

CROSS-REFERENCE TO RELATED APPLICATION

This application claims the benefit of U.S. provisional application No. 61/699,058, filed Sep. 10, 2012, the contents of which are herein incorporated by reference.

BACKGROUND OF THE INVENTION

The present invention relates to razors and, more particularly, to a multi-headed razor device.

Shaving is a time consuming venture. The size of the blade is small relative to the total area of that needs to be shaved. Currently, there are only single-handled body razors. Hair line problems may occur while shaving with a single handle razor since the single razor does not cover the total area that needs to be shaved.

As can be seen, there is a need for a multi-headed razor device that may cover more area in less time.

SUMMARY OF THE INVENTION

In one aspect of the present invention, a multi-headed razor device comprises a handle body having a first end; a plurality of handle arms having a first end and a second end, wherein the second end of the plurality of handle arms attaches to the handle body; and a plurality of razor heads removably attached to the first end of the plurality of handle arms and the first end of the handle body.

In another aspect of the present invention, a multi-headed razor device comprises a handle body having a first end; a plurality of handle arms having a first end and a second end, wherein the second end of the plurality of handle arms removably attaches to the handle body; and a plurality of razor heads removably attached to the first end of the plurality of handle arms and the first end of the handle body.

These and other features, aspects and advantages of the present invention will become better understood with reference to the following drawings, description and claims.

DETAILED DESCRIPTION OF THE INVENTION

Figure 1:
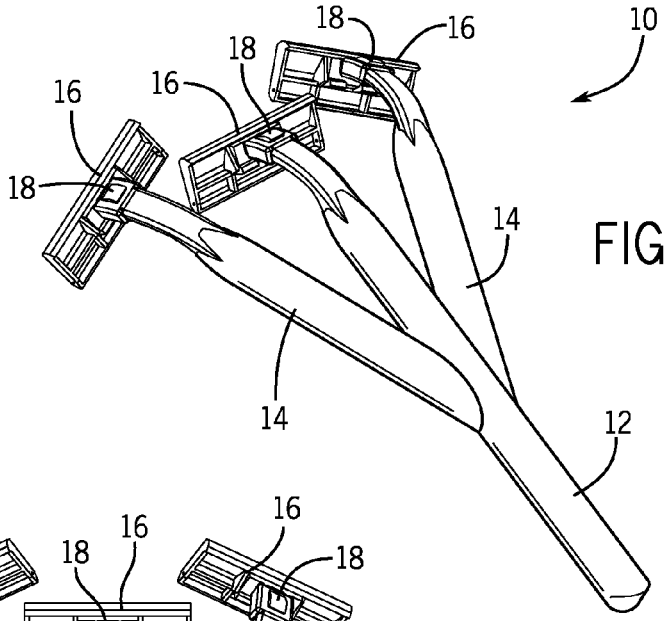
FIG. 1 is a perspective view of a multi-headed razor according to an exemplary embodiment of the present invention.
Figure 2:
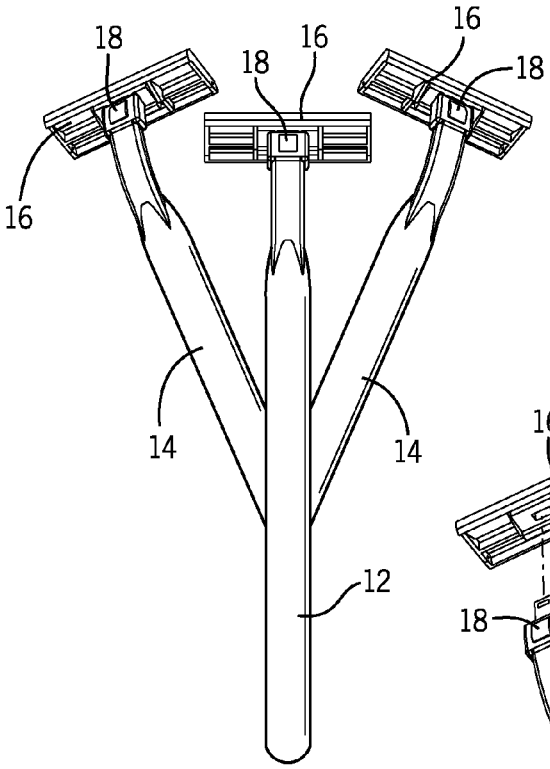
FIG. 2 is a top plan view of the multi-headed razor of FIG. 1.
Figure 3:
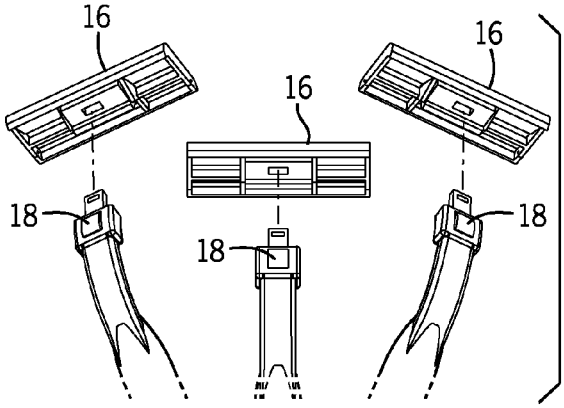
FIG. 3 is a detail view of a plurality of removable razor heads of the multi-headed razor of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a multi-headed razor device may be used to shave a surface area not covered by an individual razor. The device may include a handle body having a first end, a plurality of handle arms having a first end and a second end attached to the handle body, a plurality of razor heads attached to the first end of the handle body and the first end of the plurality of handle arms. A plurality of release buttons may be attached to the first end of the handle body and the first end of the plurality of handle arms to release the plurality of razor heads. A plurality of buttons may be attached to a top portion of the handle body to release the plurality of handle arms.

As is illustrated in FIGS. 1 through 7, a multi-headed razor device 10 according to an exemplary embodiment of the present invention may include a handle body 12. The handle body 12 may have a first end. A plurality of handle arms 14 having a first end and a second end may be attached to the handle body 12 by the second end of the plurality of handle arms 14. The plurality of handle arms 14 may be attached at an angle out from the handle body 12. A plurality of release buttons 18 may be attached to the first end of the handle body 12 and the first end of the plurality of handle arms 14. A plurality of razor heads 16 may be attached to the first end of the plurality of handle arms 14 and the first end of the handle body 12. In certain embodiments, the plurality of razor heads 16 may be removed from the device by pressing the plurality of release buttons 18.

Figure 5:
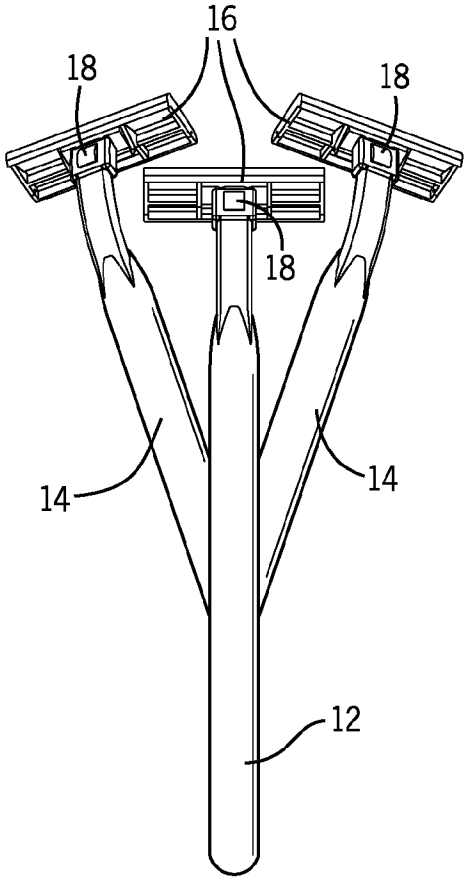
FIG. 5 is a top plan view of a multi-headed razor having their blades in a second alternate orientation, according to an exemplary embodiment of the present invention.
Figure 4:
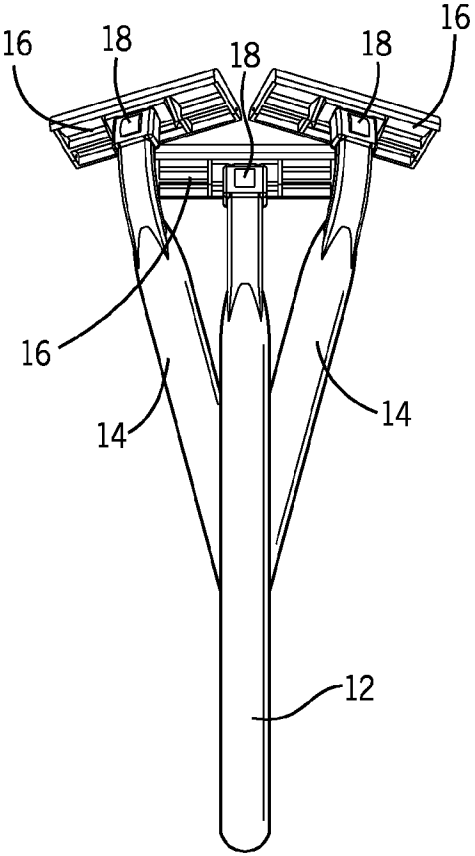
FIG. 4 is a top plan view of a multi-headed razor having their blades in an alternate orientation, according to an exemplary embodiment of the present invention.
Figure 6:
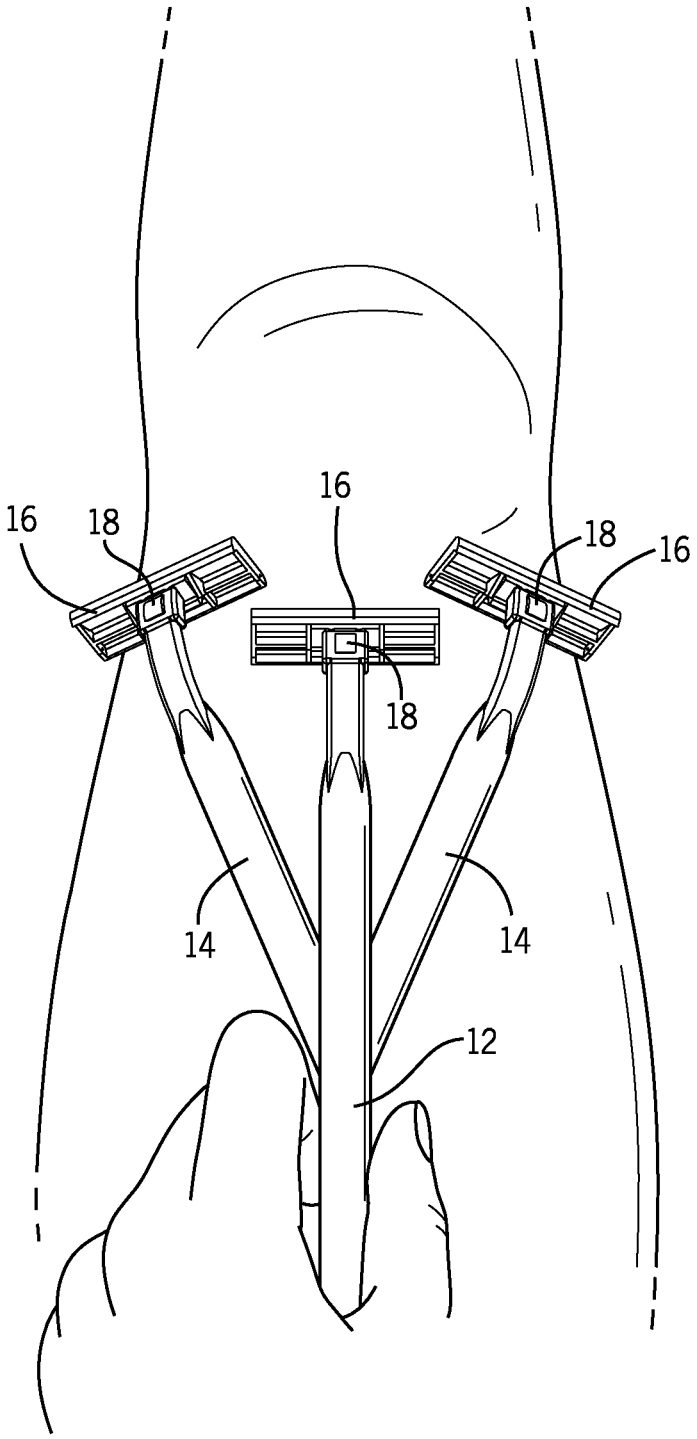
FIG. 6 is a top plan view of the multi-headed razor of FIG. 1 in use.
Figure 7:
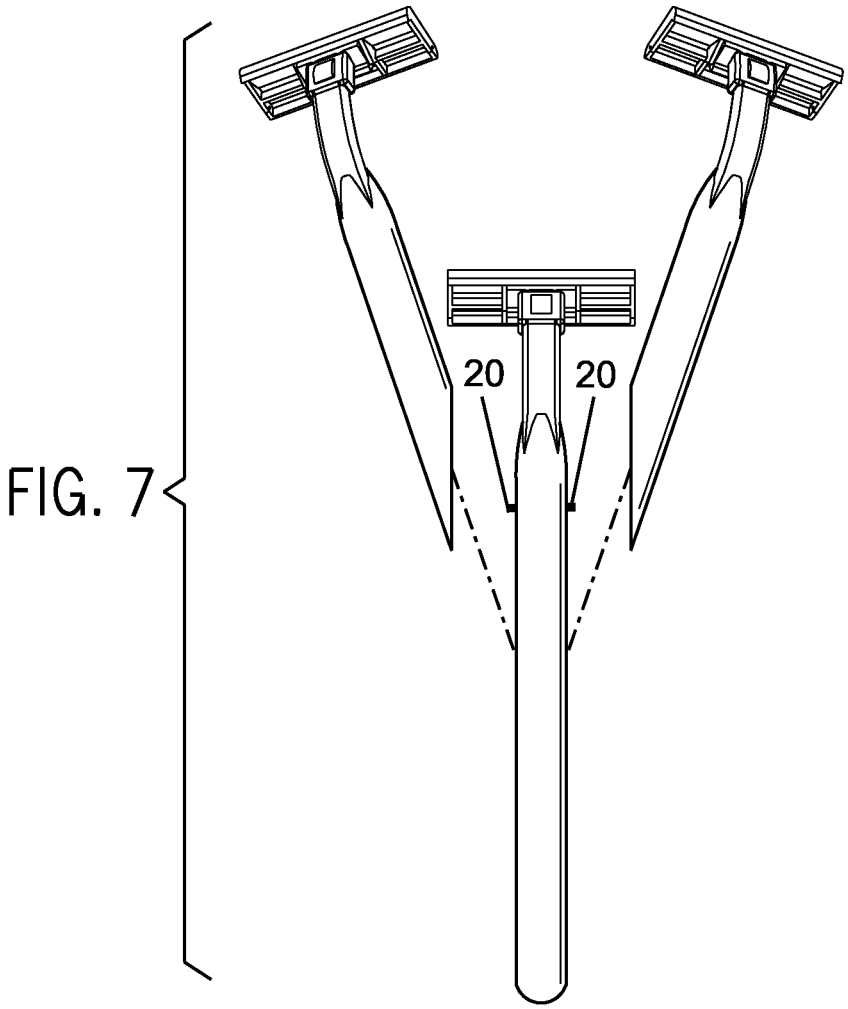
FIG. 7 is a top plan view of an alternate embodiment of the present invention.

In certain embodiments, the multi-headed razor device may have three razor heads and two handle arms. The amount of razor heads and handle arms may increase if the size of the area that needs shaving is large enough to require more surface area coverage. In certain embodiments, the handle arms may be detachable for harder areas to shave as is shown in FIG. 7. The type of razor head may be changed based on preference. In certain embodiments the razor heads may be removed to be replaced. In certain embodiments, the angle of the plurality of handle arms may be adjusted a smaller or wider area as is shown in FIGS. 4 and 5. The plurality of handle arms may attach to the handle body by, but not limited to, clicking the plurality of handle arms into the handle body. In certain embodiments, the plurality of handle arms may be attached by a catch mechanism on the handle body. In certain embodiments, the plurality of handle arms may be detached by use of a plurality of buttons 20 attached to a top portion of the handle body.

A method of using the multi-headed razor device may include gliding the device along a desired area of skin. The plurality of razor heads cover an area so that the razor paths are slightly overlapping, which allows the device to protect from forming hair lines.

It should be understood, of course, that the foregoing relates to exemplary embodiments of the invention and that modifications may be made without departing from the spirit and scope of the invention as set forth in the following claims.

What is claimed is:

1. A multi-headed razor device comprising:

a handle body extending along a longitudinal axis from a second end to a first end;

a plurality of handle arms having a first end and a second end, wherein the second end of the plurality of handle arms non-pivotably attaches to the handle body at an attachment point so that the plurality of handle arms and the handle body are co-planar, wherein each longitudinal axis of each handle arm forms an acute angle relative to the longitudinal axis of the handle body; and a plurality of razor heads removably attached to the first end of the plurality of handle arms and the first end of the handle body, wherein a distance from the first end of the handle body to the attachment point is less than a distance from each first end of the plurality of handle arms to the attachment point.

2. The multi-headed razor device of claim 1, wherein the plurality of handle arms comprises two handle arms.

3. The multi-headed razor device of claim 1, wherein the plurality of razor heads comprises three razor heads.

4. The multi-headed razor device of claim 1, further comprising a plurality of release buttons attached to the first end of the handle body and the first end of the plurality of handle arms.

5. The multi-headed razor device of claim 4, wherein the plurality of release buttons comprises three release buttons.

6. The multi-headed razor device of claim 1, wherein each handle arm un-pivotably attaches so as to adjust the acute angle to an alternative orientation or a second alternative orientation.

7. A multi-headed razor device comprising:

a handle body extending along a longitudinal axis from a second end to a first end;

a plurality of handle arms having a first end and a second end, wherein the second end of the plurality of handle arms non-pivotably and removably attaches to the handle body at an attachment point so that the plurality of handle arms and the handle body are co-planar, wherein each longitudinal axis of each handle arm forms an acute angle relative to the longitudinal axis of the handle body; and a plurality of razor heads removably attached to the first end of the plurality of handle arms and the first end of the handle body, wherein a distance from the first end of the handle body to the attachment point is less than a distance from each first end of the plurality of handle arms to the attachment point.

8. The multi-headed razor device of claim 7, wherein the plurality of handle arms comprises two handle arms.

9. The multi-headed razor device of claim 7, wherein the plurality of razor heads comprises three razor heads.

10. The multi-headed razor device of claim 7, further comprising a plurality of release buttons attached to the first end of the handle body and the first end of the plurality of handle arms.

11. The multi-headed razor device of claim 10, wherein the plurality of release buttons comprises three release buttons.

12. The multi-headed razor device of claim 7, wherein each handle arm un-pivotably attaches so as to adjust the acute angle to an alternative orientation or a second alternative orientation.

* * * * *